United States Patent [19]

Kaufmann

[11] Patent Number: 5,065,601

[45] Date of Patent: Nov. 19, 1991

[54] STRETCHABLE RASCHEL GOODS

[75] Inventor: Josef Kaufmann, Münchwilen, Switzerland

[73] Assignee: Schweizerische Gesellschaft fur Tuillindustries, AG, Munchwilen, Switzerland

[21] Appl. No.: 278,834

[22] Filed: Dec. 1, 1988

[30] Foreign Application Priority Data

Dec. 2, 1987 [DE] Fed. Rep. of Germany ..... 3740809

[51] Int. Cl.[5] ..... D04B 21/00

[52] U.S. Cl. ..... 66/195

[58] Field of Search ..... 66/195, 202, 192

[56] References Cited

U.S. PATENT DOCUMENTS

| | | | |
|---|---|---|---|
| 4,007,611 | 2/1977 | Bleard | 66/195 |
| 4,688,403 | 8/1987 | Gajjar | 66/195 |
| 4,802,346 | 2/1989 | Gajjar | 66/195 |

FOREIGN PATENT DOCUMENTS

| | | | |
|---|---|---|---|
| 1635880 | 2/1972 | Fed. Rep. of Germany | 66/193 |

OTHER PUBLICATIONS

D. F. Paling, Warp Knitting Technology, 1952, Harlequin Press, pp. 39–41.

*Primary Examiner*—Wm. Carter Reynolds
*Attorney, Agent, or Firm*—Burgess, Ryan & Wayne

[57] ABSTRACT

For the Raschel goods the threads are provided in longitudinal direction, are interconnected by loop and loop, wherein the threads consist of glass. The Raschel goods are produced by means of two guide bars, wherein the first guide bar provides alternately loop and loop and the second guide bar in reverse rhythm at the same time, and wherein the threads are supplied under predetermined bias.

5 Claims, 3 Drawing Sheets

STRETCHABLE RASCHEL GOODS

BACKGROUND OF THE INVENTION

1. Field of the Invention

The present invention is related to stretchable Raschel goods. It is more particularly related to Raschel goods that are stretchable in a wide range and which have a high recovery ability.

2. Description of the Prior Art

It is known to produce textile goods knitted from two systems of yarn and which are stretchable in at least one direction according to the forming of loops and/or by the use of stretchable yarns. Such knitted goods of natural and/or synthetic yarn are not suitable for technical purposes, especially in that case, when the technical knitted goods are exposed to a higher temperature, whereby the knitted goods are destroyed at least partially.

Further knitted goods are known that are composed of yarn consisting of organic and inorganic material in a predetermined relationship. Such knitted goods have an insufficient recovery ability. Applicant's attempts at knitting filaments of glass by fringe pattern and by a tricot pattern have shown a poor recovery ability, an irregular appearance of the goods and rolled borders of the goods.

SUMMARY OF THE INVENTION

An object of the present invention is to provide stretchable goods, wherein longitudinally arranged threads are interconnected by loop and loop, wherein loop and loop are laid according to a repeat L1: 2-0/4-4//, L2: 0-0/2-4// and wherein threads consist of yarn of glass.

The advantages, thereof, are that the Raschel goods are steady, stretchable in all directions and that meshes are formed regularly.

Another object, of the present invention is to provide stretchable Raschel goods wherein threads are ply-yarns consisting of glass. This has the advantages that the tendency to rupture is of lower degree and an extreme stretchability is achieved.

Still another object of the present invention is to provide stretchable Raschel goods wherein each of said loops is inclined with regard to the longitudinal direction and wherein the angle of inclination between a line extending from the point of intersection and the longitudinal direction of the Raschel goods is in a range of 20 to 75 degree.

The advantages thereof are that the stretchability can be improved by selecting the angle of inclination and that the Raschel goods can adapt their shape to any form or mold.

While some of the more salient features, characteristics, and the like of the above invention have been pointed out, others will become apparent from the following disclosure.

BRIEF DESCRIPTION OF THE DRAWINGS

The present invention will be more fully understood by reference to the following detailed description thereof when read in conjunction with the attached drawings, and wherein.

DESCRIPTION OF THE PREFERRED EMBODIMENT

Figure 1A:
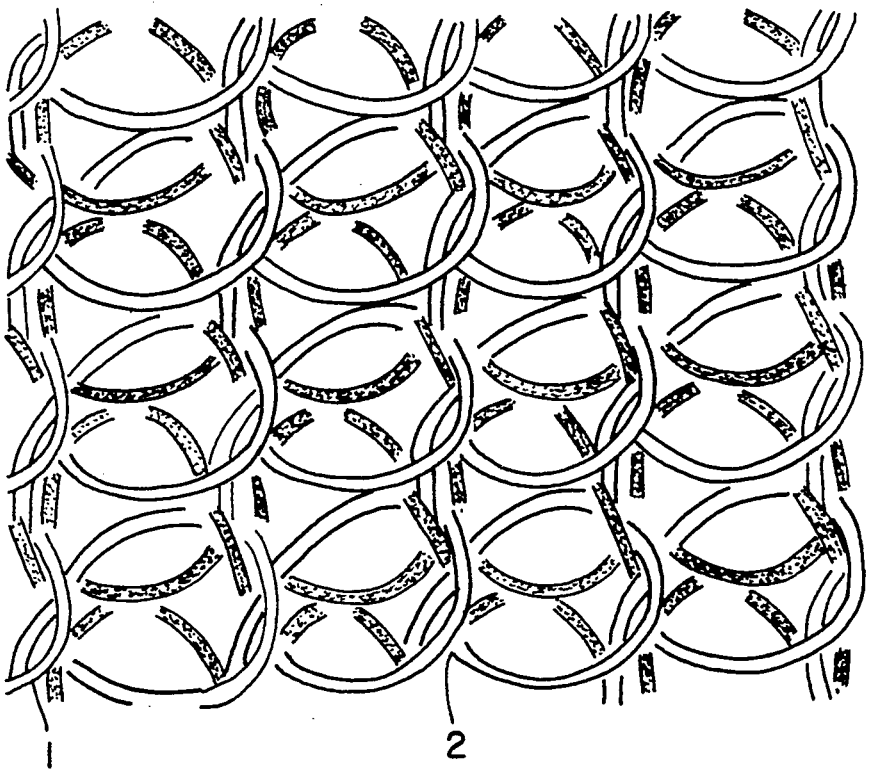
FIG. 1A shows a preferred embodiment of the Raschel goods according to the invention, and particularly to a stretchable knitted fabric which is in an unstretched condition.
Figure 1B:
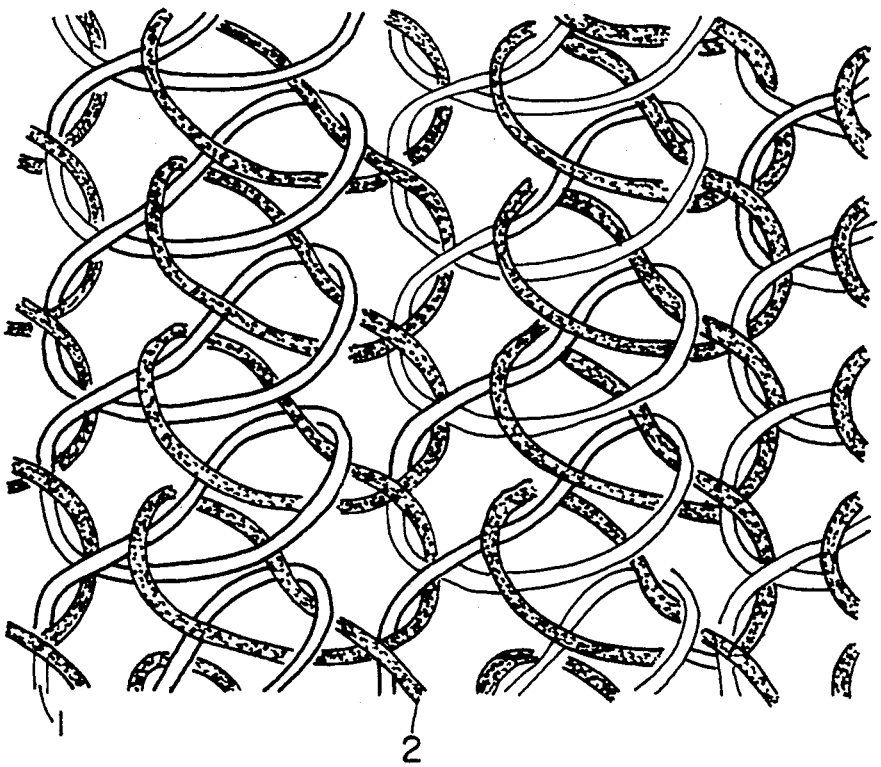
FIG. 1B shows the embodiment in FIG. 1A which is pulled in the widthwise direction.
Figure 1C:
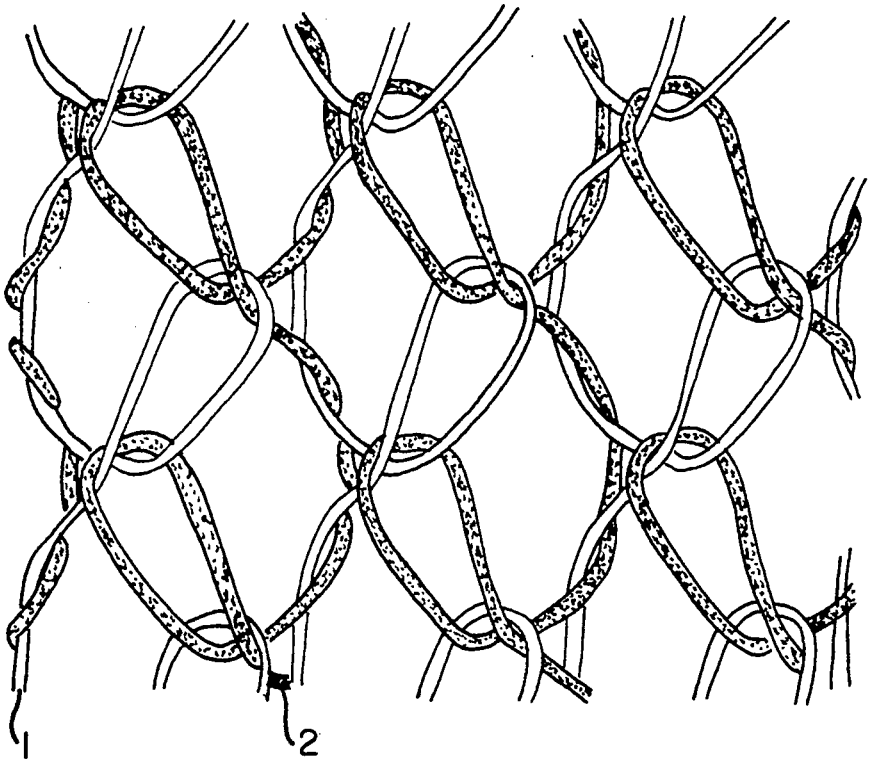
FIG. 1C shows a view of the stretchable knitted fabric in the orthodox stitch position.

As is obvious from FIG. 1, a first thread of glass 1 is alternately formed as loop and loop and a second thread of glass 2 is alternately formed as loop and loop in the Raschel goods in question. Thus a loop is formed by each glass thread in every second course only. The intersection place 3 of the loop is also only in every second course and the hindmost point 4 of the loop head is shifted with regard to the intersection place by one course. Therefore, because a loop is formed only in every second course, the loops have a wider free space and are movable. This characteristic in accordance with the invention is defined by the angle of the loop shank.

Figure 2:
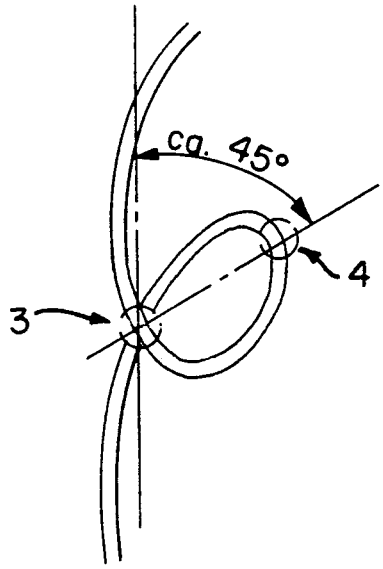
FIG. 2 shows a region of the appearance of the Raschel goods shown in FIG. 1.

FIG. 2 shows this angle on a loop formed by the glass thread 2. The shank's angle is determined by the position of the hindmost point 4 of the loop head regarding the intersection place. If the system of coordinates is placed such that the zero point lies in the intersection place and the ordinates coincide with the longitudinal direction of the Raschel goods, the angle of a straight line extending through the hindmost point 4 of the loop head amounts to 45° in the shown embodiment. It is mentioned that this angle can vary in the range of 20° to 75° in order to achieve a stretchability for the corresponding purpose of use.

Figure 3:
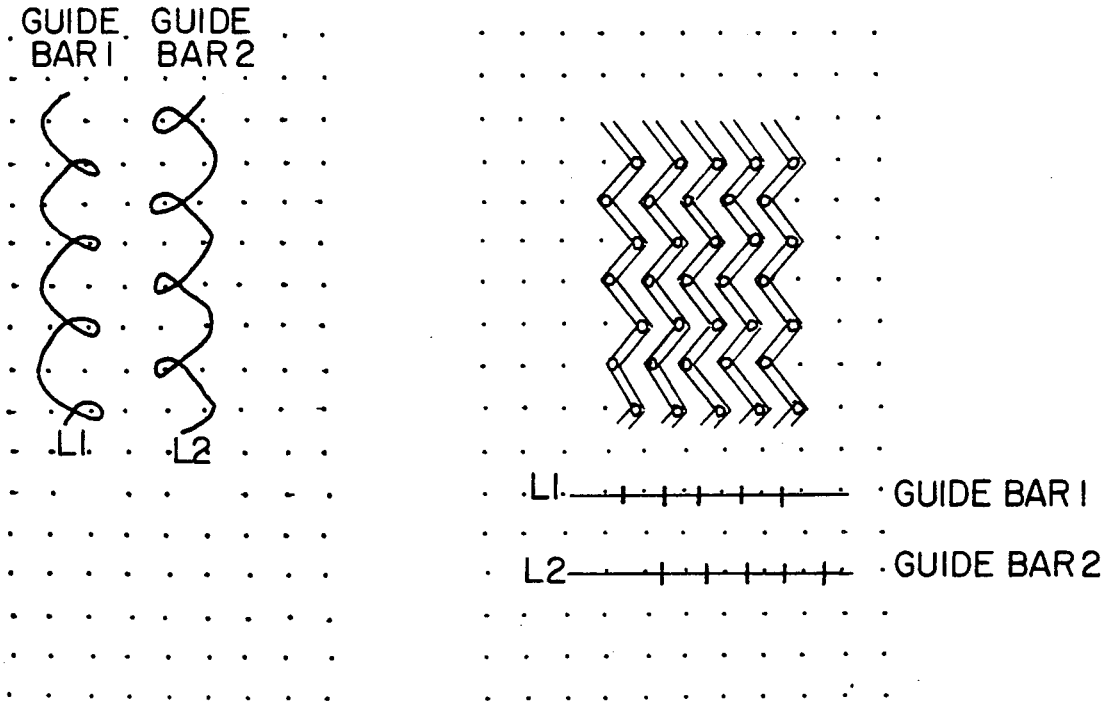
FIG. 3 is a yarn run-threading diagram according to the present invention, showing the use of two guide bars for a raschel machine.

The above described Raschel goods are produced by means of two guide bars L1 and L2, as shown in FIG. 3. In this, the first guide bar L1 provides alternately loop and loop and the second guide bar L2 in reverse rhythm at the same time; wherein the threads are supplied under predetermined bias. The finished loops and loops are under stress due to the stiffness of the glass yarn. Thus, the loop shanks are urged from each other and the loops and loops are encased. The threads can release the tension in this position. The wide stretchability of the Raschel goods results from the movability of the loops within the knitting. Therefore it is possible to stretch the Raschel goods in all directions.

This possibility is particularly advantageous when the preferred embodiment of the Raschel goods is used as reinforcing material for plastic compounds. The Raschel goods can be easily cut and inserted into the specific mold because the Raschel goods according to the present invention do not roll up.

I claim:

1. Stretchable Raschel goods wherein longitudinally arranged threads are interconnected by loop and loop, wherein loop and loop are laid according to a repeat L1: 2-0/4-4//, L2: 0-0/2-4// and wherein threads consist of glass yarn.

2. Stretchable Raschel goods of claim 1, wherein said threads are ply-yarns.

3. Stretchable Raschel goods according to claim 1, wherein said threads consist of at least one yarn.

4. Stretchable Raschel goods according to claim 1, wherein each of said loops is inclined with regard to the longitudinal direction and wherein the angle of inclination between a straight line extending from the hindmost point of the loop (4) to the point of intersection place and the longitudinal direction of the Raschel goods is in a range of 20 to 75 degree.

5. Stretchable Raschel goods, in which the longitudinally arranged threads are interconnected by loop and loop and in which loop and loop are laid according to a repeat L1: 2-0/4-4//, L2: 0-0/2-4//; said threads consist of at least one glass yarn; wherein loops are inclined with regard to the longitudinal direction and wherein the angle of inclination between a line extending from the point of intersection and the longitudinal direction of the Raschel goods is in a range of 20 to 75 degree.

* * * * *